US007946070B1

(12) United States Patent
Elhart

(10) Patent No.: US 7,946,070 B1
(45) Date of Patent: May 24, 2011

(54) SHOOTING STICK APPARATUS

(76) Inventor: Tom Elhart, Holland, MI (US)

( * ) Notice: Subject to any disclaimer, the term of this patent is extended or adjusted under 35 U.S.C. 154(b) by 661 days.

(21) Appl. No.: 11/900,627

(22) Filed: Sep. 12, 2007

Related U.S. Application Data

(60) Provisional application No. 60/843,886, filed on Sep. 12, 2006.

(51) Int. Cl.
*F41A 9/62* (2006.01)

(52) U.S. Cl. ..... 42/94; 89/37.04; 248/440.1; 248/171

(58) Field of Classification Search ..... 42/94; 89/37.04; 248/440.1, 171
See application file for complete search history.

(56) References Cited

U.S. PATENT DOCUMENTS

| | | | | | |
|---|---|---|---|---|---|
| 3,235,997 | A | * | 2/1966 | Stoner | 42/94 |
| 3,999,461 | A | * | 12/1976 | Johnson et al. | 89/191.01 |
| 4,265,045 | A | | 5/1981 | Garbini | |
| 4,309,099 | A | | 1/1982 | Flint | |
| 4,351,224 | A | | 9/1982 | Curtis | |
| 4,607,561 | A | * | 8/1986 | Frimer | 89/37.04 |
| 4,676,021 | A | | 6/1987 | Groba | |
| 5,194,678 | A | * | 3/1993 | Kramer | 42/94 |
| D334,963 | S | | 4/1993 | Emanuelson | |
| 5,311,693 | A | | 5/1994 | Underwood | |
| 5,345,706 | A | * | 9/1994 | Brown | 42/94 |
| 5,406,732 | A | | 4/1995 | Peterson | |
| 5,410,835 | A | | 5/1995 | Vetter | |
| 5,507,111 | A | | 4/1996 | Stinson et al. | |
| D386,510 | S | * | 11/1997 | Peterson | D16/244 |
| 5,711,103 | A | * | 1/1998 | Keng | 42/94 |
| D390,301 | S | * | 2/1998 | Peterson | D22/108 |
| 5,778,589 | A | | 7/1998 | Teague | |
| 5,930,932 | A | | 8/1999 | Peterson | |
| 6,289,622 | B1 | * | 9/2001 | Desch et al. | 42/94 |
| D470,165 | S | * | 2/2003 | Peterson | D16/244 |
| 6,663,071 | B2 | | 12/2003 | Peterson | |
| 6,763,627 | B1 | | 7/2004 | Kaempe | |
| 6,843,015 | B2 | * | 1/2005 | Sharp | 42/94 |
| 7,000,875 | B2 | * | 2/2006 | Pernstich et al. | 248/168 |
| 7,032,494 | B2 | | 4/2006 | Wygant | |
| 7,380,486 | B1 | * | 6/2008 | Bean | 89/37.04 |
| 7,401,431 | B2 | * | 7/2008 | Pierce et al. | 42/94 |
| 7,409,791 | B2 | * | 8/2008 | Moody et al. | 42/72 |
| 7,426,800 | B2 | * | 9/2008 | Pierce et al. | 42/94 |
| 7,571,563 | B2 | * | 8/2009 | Peterson | 42/94 |
| 7,631,455 | B2 | * | 12/2009 | Keng et al. | 42/94 |
| 7,654,498 | B1 | * | 2/2010 | Beltz | 248/351 |
| 7,676,977 | B1 | * | 3/2010 | Cahill et al. | 42/94 |
| 7,743,545 | B1 | * | 6/2010 | Moody et al. | 42/94 |
| 7,823,855 | B2 | * | 11/2010 | Faifer | 248/440.1 |
| 2007/0151999 | A1 | * | 7/2007 | Thompson | 224/150 |

* cited by examiner

*Primary Examiner* — Michael Carone
*Assistant Examiner* — Michael D David
(74) *Attorney, Agent, or Firm* — The Watson I.P. Group, PLC; Jovan N. Jovanovic; Vladan M. Vasiljevic

(57) ABSTRACT

A shooting stick apparatus having a stick assembly and a system for adjusting the first and second stick members relative to each other. The stick assembly has a first stick member and a second stick member. The adjusting system has a first stick receiver and a second stick receiver pivotably coupled to the first stick receiver. A locking system is configured for locking the stick members and the stick receivers relative to each other.

20 Claims, 7 Drawing Sheets

SHOOTING STICK APPARATUS

CROSS-REFERENCE TO RELATED APPLICATION

This application claims priority from U.S. Provisional Patent Application Ser. No. 60/843,886 entitled "Shooting Stick Apparatus" filed Sep. 12, 2006, the entire specification of which is hereby incorporated by reference in its entirety.

BACKGROUND OF THE INVENTION

1. Field of the Invention

The invention relates in general to hunting equipment, and more particularly, to a shooting stick apparatus which provides for a stable platform upon which to rest a rifle or other firearm. The shooting stick apparatus is preferably both adjustable and usable as a walking stick.

2. Background Art

The use of shooting sticks and other bipod type devices to stabilize a rifle or other firearm is well known in the art. For example, a number of different shooting sticks are available on the market. Certain of these are disclosed in the following issued patents: U.S. Pat. No. 5,410,835 issued to Vetter; U.S. Pat. No. 5,507,111 issued to Stinson, et al.; U.S. Pat. No. 5,930,932 issued to Peterson; U.S. Pat. No. 5,311,693 issued to Underwood; and U.S. Pat. No. 5,406,732 issued to Peterson. The specifications of each of the foregoing patents is incorporated by reference herein in their entirety. The aforementioned shooting sticks are typically adjustable such that the angle of the two sticks and/or the point of intersection of the two sticks can be varied.

While such shooting sticks have had some success, there are nevertheless drawbacks to the aforementioned devices. For example, it is often difficult to adjust the two sticks relative to each other. This is especially true in high brush or in deep snow. The adjustment devices often require significant manipulation which may be difficult to accomplish quickly. Furthermore, certain of the devices lack the necessary rigidity and lack the required strength necessary for repeated use. Finally, certain of the devices are too cumbersome to carry for extended periods of time.

It is an object of the present invention to provide an enhanced and improved shooting stick which overcomes the aforementioned deficiencies.

This object as well as other objects of the present invention will become apparent in light of the present specification, claims, and drawings.

SUMMARY OF THE INVENTION

The invention is directed to a shooting stick apparatus comprising a stick assembly having first and second stick members and means for adjusting stick members. The adjusting means comprises a first stick receiver, a second stick receiver, and locking means. The first stick receiver includes a stick receiving assembly wherein the first stick member is selectively slidably movable therethrough. The second stick receiver includes a stick receiving assembly wherein the second stick member is selectively slidably movable therethrough. The first stick receiver is pivotably coupled to the second stick receiver so that they pivot about an axis of rotation. The locking means locks the first and second stick members to the respective first and second stick receiving assemblies and the first and second stick receiving assemblies to each other so as to preclude slidable movement of the first and second stick members and to preclude relative pivotable movement of the first and second stick members.

In a preferred embodiment, each of the first and second stick members comprise a plurality of segments which are telescopically coupled to each other. In turn, the telescoped regions facilitate a collapsed orientation and an erected orientation.

In yet another preferred embodiment, the locking means further comprises a first stick retaining structure and a second stick retaining structure. Each of the first and second retaining structures further comprise a pivot axle, a stick grasping member, a biasing member and an activation member. The stick grasping member is coupled to the pivot axle. The biasing member forces the stick grasping member into operative engagement with the stick receiving assembly, to, in turn, releasably restrain the respective stick member. The activation member is coupled to the pivot axle and interfaces with the biasing member. Activation of the activation member overcomes the biasing member to facilitate slidable movement of the respective stick member.

In a preferred embodiment, the stick grasping member further comprises a co-molded surface which contacts the respective stick member.

In a preferred embodiment, the activation members are on opposite ends of the adjusting means. Pressing opposing ends of the adjusting means inwardly facilitates release of the locking means.

In another preferred embodiment, the biasing member comprises a compression spring.

In one such preferred embodiment, the pivot axle and the stick grasping member comprise an integrally molded component. The stick grasping member comprises a substantially circular member having an inner surface and an outer surface.

In yet another preferred embodiment, the activation member is coupled to the pivot axle by way of a fastener.

In another preferred embodiment, the apparatus further comprises a handle assembly integrally associated with each of the first and second stick receiving assemblies.

In another preferred embodiment, the handle assembly extends over at least a portion of each of the first stick member and the second stick member.

Preferably, the handle assembly further comprises first handle half coupled to the first stick member and a second handle half coupled to the second stick member. The first and second handle halves cooperate to form a handle member when the shooting stick apparatus is in a collapsed configuration.

In a preferred embodiment, each of the first handle half and the second handle half further include a gun nesting surface. The gun nesting surfaces become exposed upon pivoting of the first stick member relative to the second stick member.

In a preferred embodiment, each of the handle halves further include a nesting gripping assembly. Each gripping assembly is shaped so as to conform to the hand of a user grasping the nesting gripping assembly of the handle halves.

In another aspect of the invention, the invention comprises an adjustment mechanism. The adjustment mechanism can be utilized in cooperation with stick members that may be separated provided by a user. It is contemplated that the adjustment mechanism may be provided with specialized stick members.

BRIEF DESCRIPTION OF THE DRAWINGS

The invention will now be described with reference to the drawings wherein.

DETAILED DESCRIPTION OF THE INVENTION

Figure 1A:
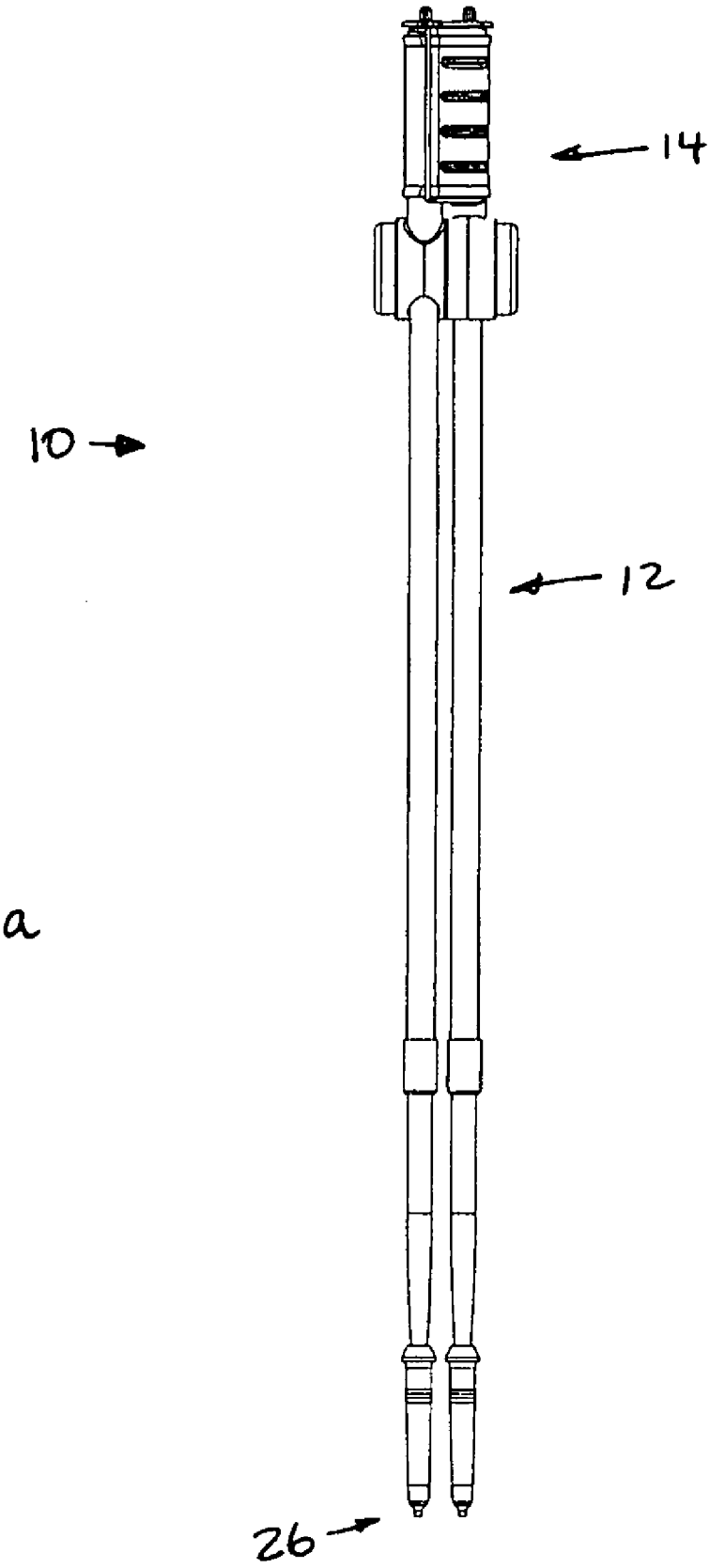
FIG. 1*a* of the drawings comprises a side elevational view of a shooting stick apparatus of the present invention in a collapsed configuration.

While this invention is susceptible of embodiment in many different forms, there is shown in the drawings and described herein in detail a specific embodiment with the understanding that the present disclosure is to be considered as an exemplification of the principles of the invention and is not intended to limit the invention to the embodiment illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Figure 1B:
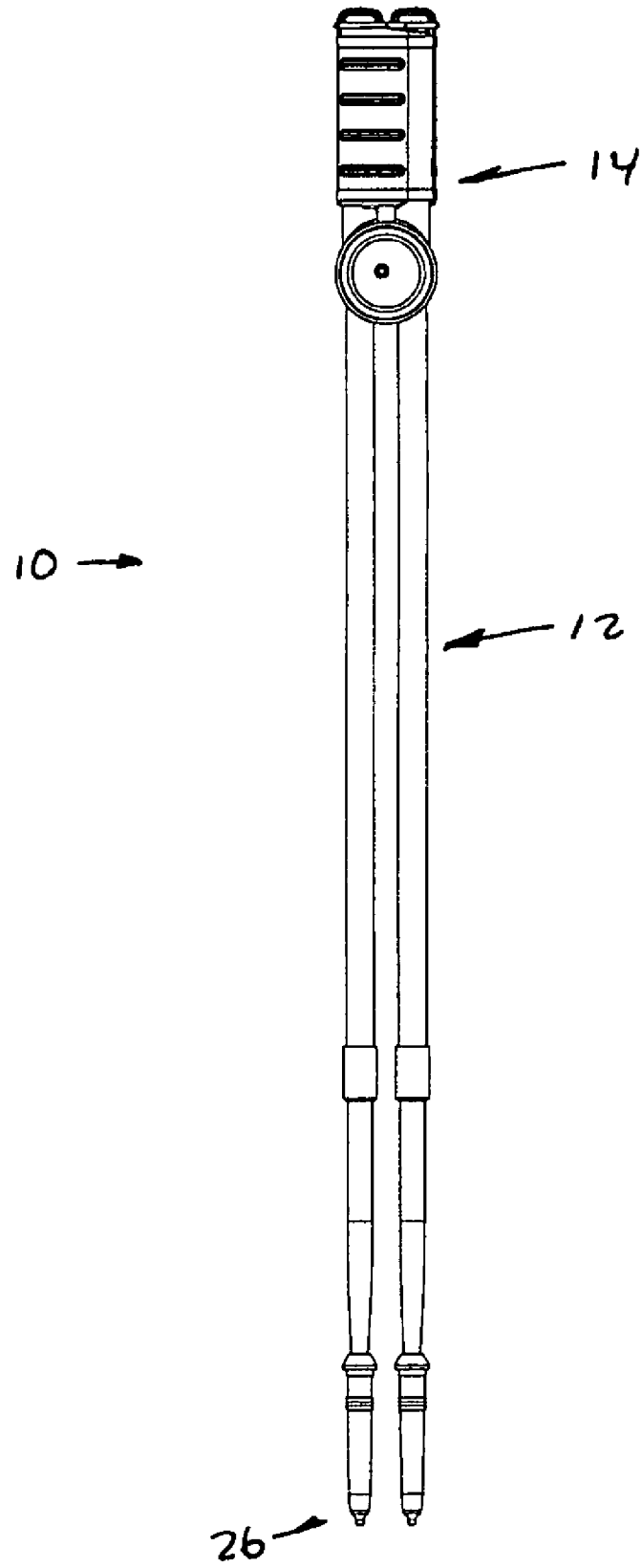
FIG. 1*b* of the drawings comprises a front elevational view of a shooting stick apparatus of the present invention in a collapsed configuration.
Figure 2:
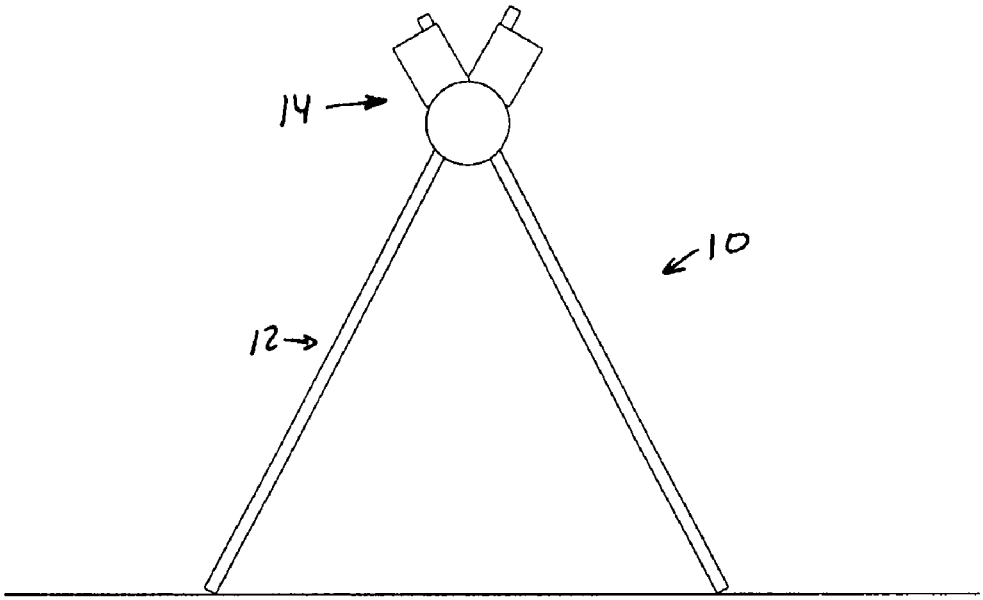
FIG. 2 of the drawings comprises a front elevational view of a shooting stick apparatus of the present invention in an articulated configuration.

Referring now to the drawings and in particular to FIGS. 1*a*, 1*b* and 2, a shooting stick apparatus is shown generally at 10 (hereinafter, the apparatus). The apparatus 10 includes stick assembly 12 and means 14 for adjusting the stick members relative to each other. It is contemplated that the apparatus be used in conjunction with a rifle or other firearm so as to provide a hunter with a stable platform from which to shoot.

Figure 3:
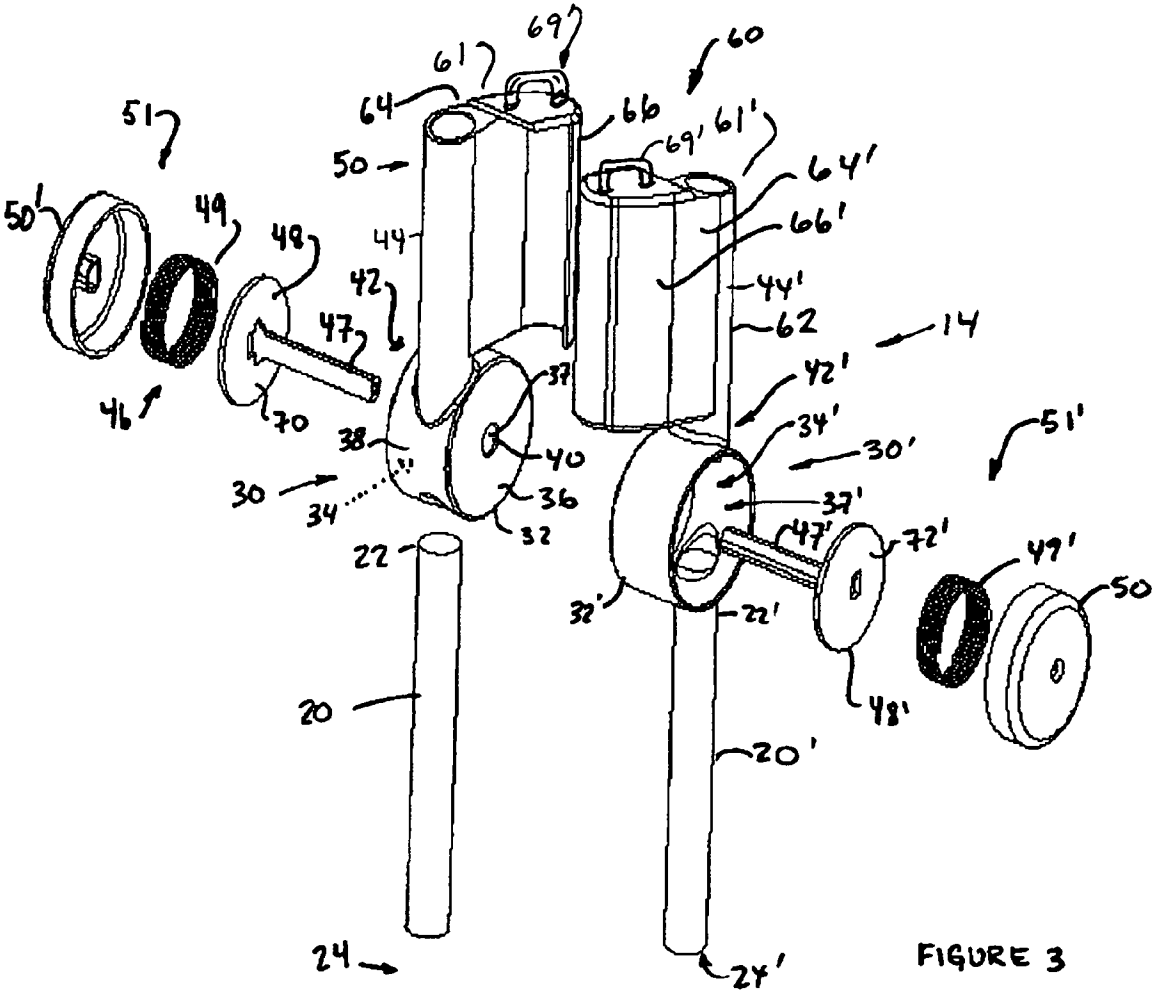
FIG. 3 of the drawings comprises an exploded perspective view of a shooting stick apparatus of the present invention.

Stick assembly 12 is shown in greater detail in FIGS. 3 and/or 4 as comprising first stick member 20 and second stick member 20'. It will be understood that the stick members are essentially duplicates of one another. Accordingly, the first stick member 20 will be described with the understanding that the second stick member 20' is substantially identical thereto. Additionally, common reference numbers will be augmented with a prime (') on the second stick member 20'. Stick member 20 comprises an elongated shaft that extends from first end 22 to second end 24. A ground engaging member 26 (FIG. 1) is positioned proximate the second end 24. With further reference to FIG. 1, additional features, such as flanges found on walking sticks, ski poles and the like may be incorporated into the second end 24. Typically, the stick member 20 comprises a substantially cylindrical member which may be of a consistent diameter, or which may be of a diameter which tapers at any point along the stick member.

In certain embodiments, the stick member may comprise multiple members that are attached together. In certain embodiments, the stick member may have a number of different segments which can fold relative to each other, but which can be attached end to end. A biasing member, such as a bungee cord can provide the necessary force to maintain the members in a end to end configuration. In other embodiments, the stick member may have multiple members that telescope relative to each other. In other embodiments, the stick member may comprise a single unitary member. Typically, the stick member is formed from any one of a number of different materials. Such materials include but are not limited to metals, alloys thereof, composites (such as graphite composites), wood, and combinations of the foregoing. The invention is not limited to any particular configuration of the first stick member or the second stick member, and the configurations of each do not need to be identical or to otherwise match for any particular application.

Figure 4:
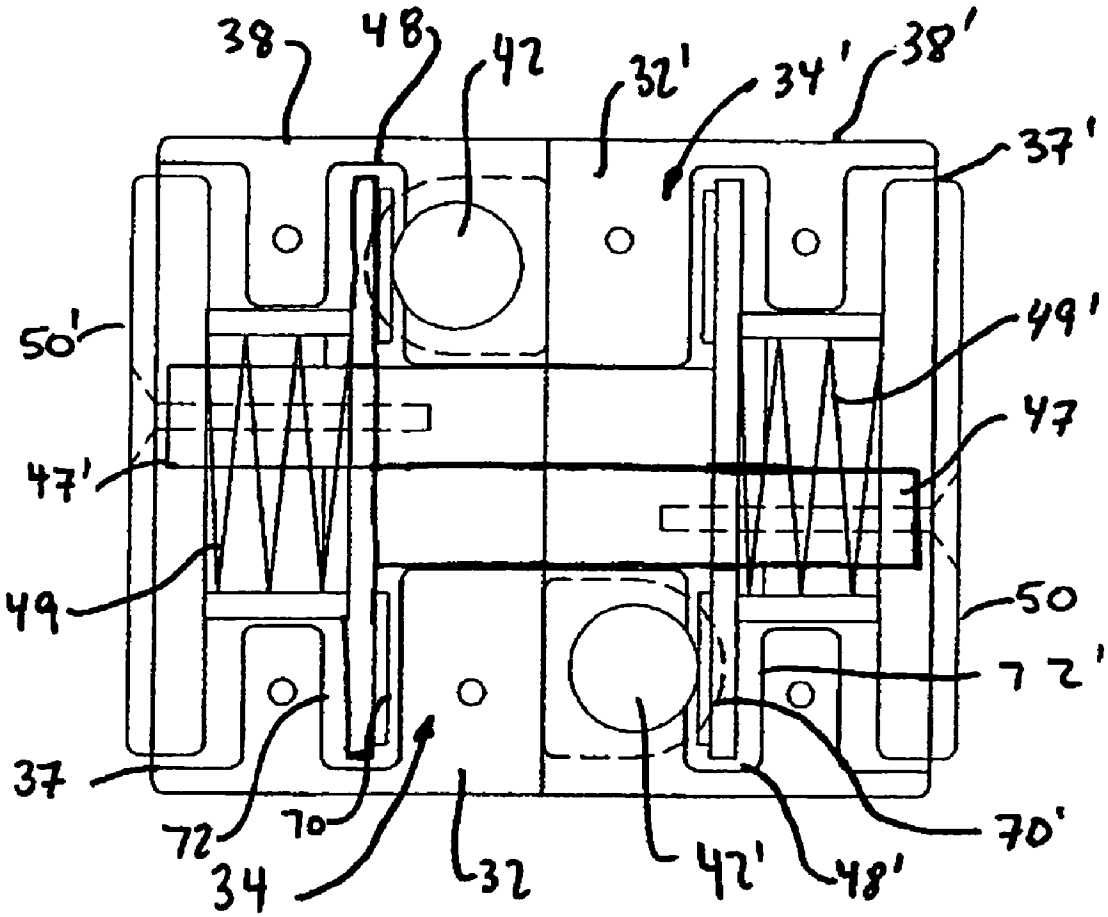
FIG. 4 of the drawings comprises a cross-sectional view of a shooting stick apparatus of the present invention, showing in particular, the adjustment means thereof.

Adjustment means 14 is shown in FIGS. 3, 4 and/or 6 as comprising first stick receiver 30, second stick receiver 30', means 46 for locking the first and second stick members relative to each other, and handle assembly 50. It will be understood that the first stick receiver 30 and the second stick receiver 30' are substantially identical. As such, the first stick receiver will be described in detail with the understanding that the second stick receiver is substantially identical. Common features found on the second stick receiver 30' will utilize the same reference number as the corresponding structure on the first stick receiver 30 augmented with a prime (').

The first stick receiver 30 includes housing 32, pivot attachment 40 and stick receiving assembly 42. Housing 32 includes base wall 36, perimeter wall 38 extending therefrom and opening 37. The base wall and the perimeter wall cooperate to define cavity 34 to which opening 37 provides ingress and egress. Pivot attachment 40 is shown as comprising a opening positioned in base wall 36. Stick receiving assembly 42 comprises an elongated channel which forms a cord with perimeter wall 38, extending through the perimeter wall 38 in two locations. The elongated channel is configured so as to receive the first stick member therethrough. Within the cavity, at least a portion of the stick member is exposed.

The second stick receiver 30' comprises a substantially complementary member. The first and second stick members 30, 30' are configured so as to be positioned with base walls 36 facing each other (in, for example, an abutting relationship). The pivot attachment 40 and the pivot attachment 40' substantially correspond to each other, and are freely rotatable relative to each other.

The locking means 46 is shown in FIGS. 3 and/or 4 as comprising first stick retaining structure 51 and second stick retaining structure 51'. It will be understood that the first and second stick retaining structures are substantially identical. As such, the first stick retaining structure will be described with the understanding that the second stick retaining structure is substantially identical. Common structures will be identified with identical reference numbers augmented with a prime (').

First stick retaining structure comprises pivot axle 47, stick grasping member 48, first biasing member 49 and activation member 50. The pivot axle 47 is preferably integrated with the stick grasping member 48 which comprises a substantially planar member having an inner surface 70 and an outer surface 72. The inner surface 70 may include a tacky surface finish (or a co-molded configuration) which engages the respective stick member extending therethrough. The pivot axle extends through the pivot attachment 40 and interfaces with the activation member 50 positioned on the opposing receiver. The two structures of each receiver cooperate to provide an axis upon which the respective stick receivers can be rotated.

The biasing member is positioned so as to co-act with the inner surface 70 of the stick grasping member. The biasing member typically comprises a spring, such as, for example, a coil spring having a coiling diameter which corresponds to the base wall 36 of the housing of the respective stick receiver. In other embodiments, various spring structures may be utilized, such as lever spring, leaf springs and the like. The invention is not limited to any particular type of biasing member. Activation member 50 is shown as comprising a button which is precluded from outward movement beyond the opening 37' of the housing 30', but which can translate toward and away from the base wall. It will be understood that as the activation member is pressed inward, the biasing member is overcome and the inner surface of the stick grasping member 48' releases its biasing retention of a stick that extends through the elongated tube 44'.

Figure 5:
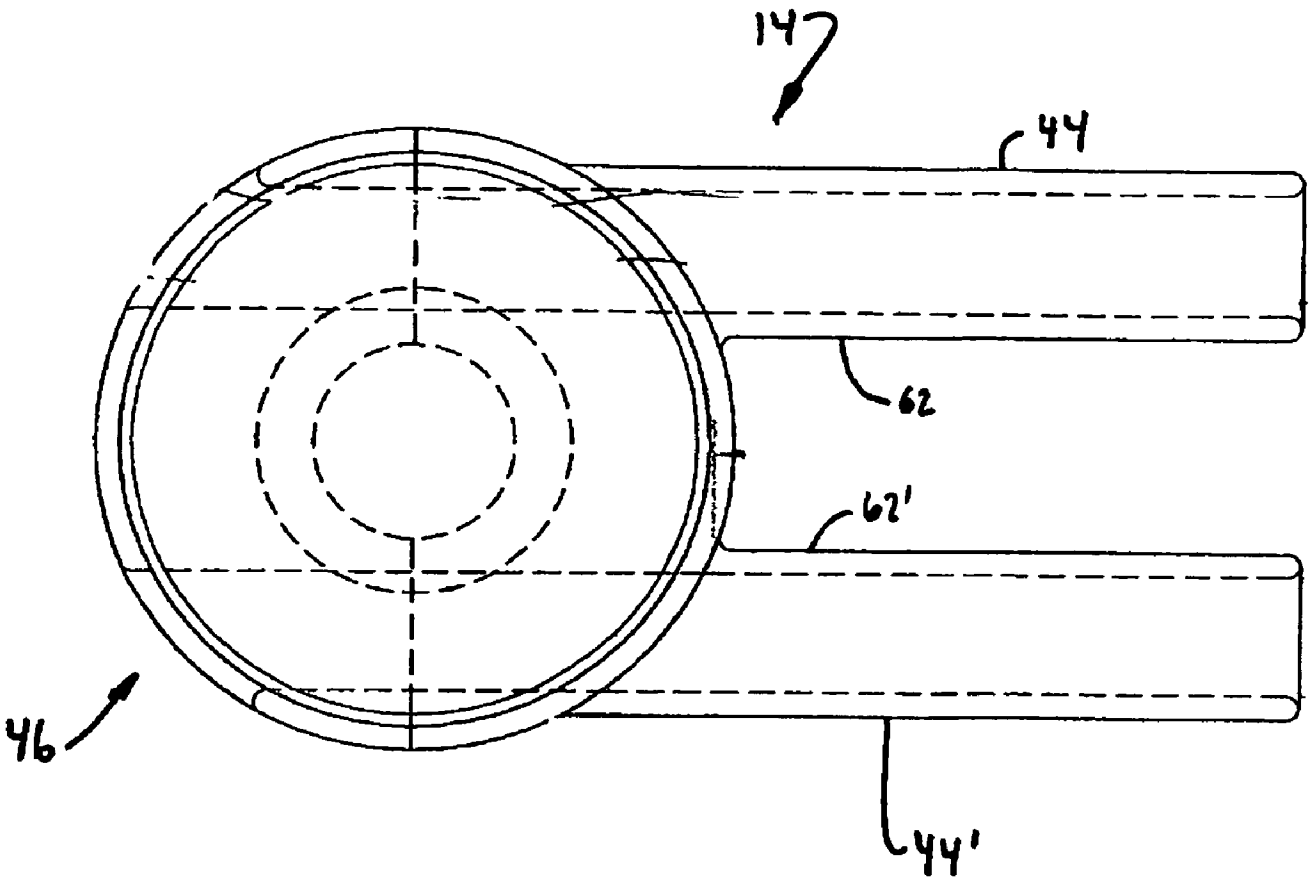
FIG. 5 of the drawings comprises a front plan view of an adjustment means not including a handle assembly.
Figure 6:
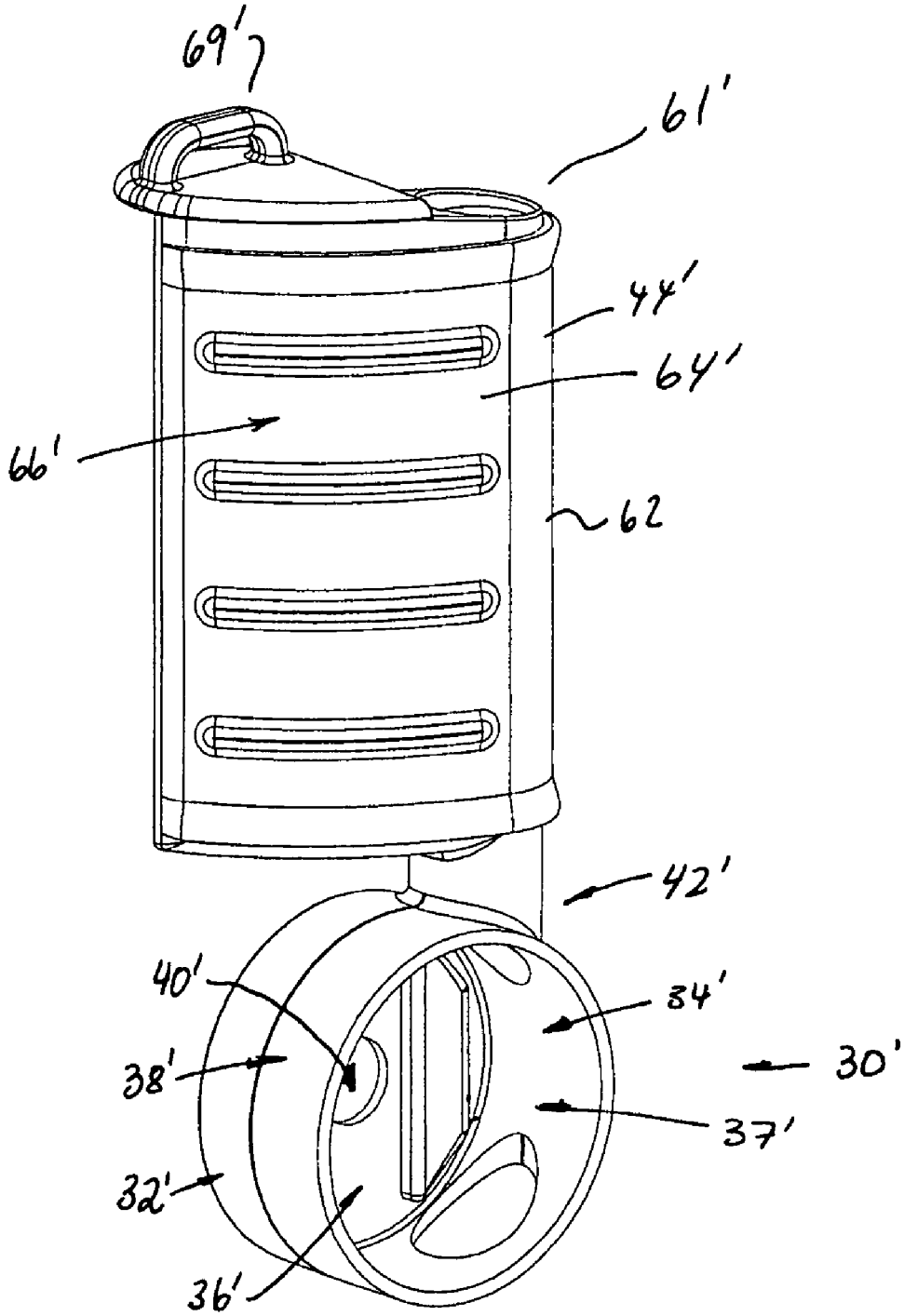
FIG. 6 of the drawings comprises a perspective view of the second stick receiver and the second handle half.

Handle assembly 60 is shown in FIG. 3 as comprising a pair of handle halves 61, 61' which nest with each other to form a handle which facilitates the use of the apparatus as a walking stick. Each handle half includes a gun resting surface 62 (FIGS. 3, 5 and 6) which essentially extends from the outer surface of the respective elongated tube 44, and a nesting gripping assembly 64. The nesting gripping assembly includes an outer surface 66 which is configured to co act with the other handle half so as to provide a suitable surface which a user can grasp. Additionally, the outer surface 66 may be co-molded with a relatively softer polymer member to aid in gripping. Wrist straps (not shown) may be coupled to strap retainer loops 69, 69' so as to provide additional retention and to otherwise aid the user.

Preferably, the adjustment means 14 includes components which are formed from a plastic material and/or a rubber material suitable for such use. The components maybe molded and assembled to form the requisite construction. Of course, metal members, as well as composites are likewise contemplated for use.

To assemble and utilize the apparatus, a fully assembled adjustment means 14 is provided. Such an adjustment means includes a stick receiving assembly for each of the first and second stick members. To assemble the device, the user first pushes in the opposing activation member 50, 50' toward each other. In turn, each of the biasing members 49, 49' are overcome and the respective stick grasping members 48, 48' move away from each other. As they are moved, elongated tube 44 is free from obstructions and the first stick member 20 can be inserted therethrough.

Similarly, elongated tube 44', at the same time, is free from obstructions and the second stick member 20' is inserted therethrough. Once inserted, the sticks are first positioned in a collapsed configuration abutting each other and the adjustment means is positioned at the first end of the respective stick members 20, 20'.

The activation members 50, 50' are then released, whereupon, the respective stick members are grasped by the means 46 for locking the translative movement of the stick members. In turn, the stick members can no longer move relative to the adjustment means 14, but can rotate relative to each other. Advantageously, in such a collapsed configuration, the first and second handle halves cooperate to form an integrated handle assembly 60. In turn, the apparatus can be utilized as a walking stick. The advantages of a walking stick can be exemplified by providing structures at the second end of the respective stick members for grasping the ground, or for precluding the sinking of the sticks into the ground.

To utilize the apparatus as a shooting stick, the user can freely rotate the first stick receiver relative to the second stick receiver so as to alter the angle of the two stick members relative to each other. Additionally, the user can again grasp the adjustment means 14 and press in the opposing activation members 50, 50' so as to release the force exerted by the biasing members against the stick grasping members and the stick members. Thus, the user can translate each pole within the respective stick receiving assembly. In turn, the relative position of the adjustment means changes in the vertical direction. Once the desired orientation is achieved, the user can release the activation members and re-lock the stick members relative to the locking means.

Of particular advantage is that the user can freely rotate the two sticks to a desired angle. Subsequently, the sticks can be placed such that the second ends co-act with the ground. Once the sticks interface the ground, the user can force the adjustment means up or down. Upward or downward movement of the adjustment means alters the relative angle of the two stick members and also translates the stick members through the stick receiving assembly without altering the point contact of the second ends of the stick members relative to the ground. This operation can be accomplished with the present device quickly and in a single handed operation. Moreover, such an operation is particularly useful wherein the stick members were driven into a deep mud or snow.

Once the user is finished with the use of the device, the device can be returned to a position wherein the sticks are relatively parallel to each other and wherein the handle assembly is formed proximate the first end of the first and second stick members. Additionally, in certain embodiments wherein the stick members can be collapsed, the user can collapse the stick members and stow the device.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. A shooting stick apparatus comprising:

a stick assembly having a first stick member and a second stick member;

means for adjusting the first and second stick members relative to each other, the means comprising, a first stick receiver including a stick receiving assembly wherein the first stick member is selectively slidably movable therethrough;

a second stick receiver including a stick receiving assembly wherein the second stick member is selectively slidably movable therethrough, wherein the first stick receiver is pivotably coupled to the second stick receiver so that they pivot about an axis of rotation;

means for locking the first and second stick members to the respective first and second stick receiving assemblies and the first and second stick receiving assemblies to each other so as to preclude slidable movement of the first and second stick members and to preclude relative pivotable movement of the first and second stick members.

2. The shooting stick apparatus of claim 1 wherein each of the first and second stick members comprise a plurality of segments which are telescopically coupled to each other, to in turn, facilitate a collapsed orientation and an erected orientation.

3. The shooting stick apparatus of claim 1 wherein the locking means further comprises a first stick retaining structure and a second stick retaining structure, each of the first and second retaining structures further comprising:

a pivot axle;

a stick grasping member coupled to the pivot axle;

a biasing member forcing the stick grasping member into operative engagement with the stick receiving assembly, to, in turn, releasable restrain the respective stick member; and an activation member coupled to the pivot axle and interfacing with the biasing member, wherein activation of the activation member overcomes the biasing member to facilitate slidable movement of the respective stick member.

4. The shooting stick apparatus of claim 3 wherein the stick grasping member further comprises a co-molded surface which contacts the respective stick member.

5. The shooting stick apparatus of claim 4 wherein the biasing member comprises a compression spring.

6. The shooting stick apparatus of claim 3 wherein the activation members are on opposite ends of the adjusting means, such that pressing opposing ends of the adjusting means inwardly facilitates release of the locking means.

7. The shooting stick apparatus of claim 3 wherein the pivot axle and the stick grasping member comprise an integrally molded component, wherein the stick grasping member comprises a substantially circular member having an inner surface and an outer surface.

8. The shooting stick apparatus of claim 7 wherein the activation member is coupled to the pivot axle by way of a fastener.

9. The shooting stick apparatus of claim 1 further comprising a handle assembly integrally associated with each of the first and second stick receiving assemblies.

10. The shooting stick apparatus of claim 1 wherein the handle assembly extends over at least a portion of each of the first stick member and the second stick member.

11. The shooting stick apparatus of claim 10 wherein the handle assembly further comprises first handle half coupled to the first stick member and a second handle half coupled to the second stick member, the first and second handle halves cooperate to form a handle member when the shooting stick apparatus is in a collapsed configuration.

12. The shooting stick apparatus of claim 11 wherein each of the first handle half and the second handle half further include a gun nesting surface which becomes exposed upon pivoting of the first stick member relative to the second stick member.

13. The shooting stick apparatus of claim 12 wherein each of the handle halves further include a nesting gripping assembly, each gripping assembly shaped so as to conform to the hand of a user grasping the nesting gripping assembly of the handle halves.

14. The shooting stick apparatus of claim 13 further comprising a handle assembly integrally associated with each of the first and second stick receiving assemblies.

15. A adjustment mechanism for adjusting a first and a second stick member relative to each other, to facilitate slidable movement of a first and a second stick member relative to each other and pivotable movement relative to each other comprising, a first stick receiver including a stick receiving assembly wherein a first stick member is selectively slidably movable therethrough;

a second stick receiver including a stick receiving assembly wherein a second stick member is selectively slidably movable therethrough, wherein the first stick receiver is pivotably coupled to the second stick receiver so that they pivot about an axis of rotation;

means for locking a first and a second stick member to the respective first and second stick receiving assemblies and the first and second stick receiving assemblies to each other so as to preclude slidable movement of the first and second stick members and to preclude relative pivotable movement of the first and second stick members.

16. The shooting stick apparatus of claim 15 wherein the locking means further comprises a first stick retaining structure and a second stick retaining structure, each of the first and second retaining structures further comprising:

a pivot axle;

a stick grasping member coupled to the pivot axle;

a biasing member forcing the stick grasping member into operative engagement with the stick receiving assembly, to, in turn, releasably restrain the respective stick member; and an activation member coupled to the pivot axle and interfacing with the biasing member, wherein activation of the activation member overcomes the biasing member to facilitate slidable movement of the respective stick member.

17. The shooting stick apparatus of claim 16 wherein the stick grasping member further comprises a co-molded surface which contacts the respective stick member.

18. The shooting stick apparatus of claim 16 wherein the activation members are on opposite ends of the adjusting means, such that pressing opposing ends of the adjusting means inwardly facilitates release of the locking means.

19. The shooting stick apparatus of claim 16 wherein the pivot axle and the stick grasping member comprise an integrally molded component, wherein the stick grasping member comprises a substantially circular member having an inner surface and an outer surface.

20. The shooting stick apparatus of claim 19 wherein the activation member is coupled to the pivot axle by way of a fastener.

* * * * *